US009108308B2

(12) United States Patent
Tsubakimoto et al.

(10) Patent No.: US 9,108,308 B2
(45) Date of Patent: Aug. 18, 2015

(54) SWITCH OPERATION DEVICE

(71) Applicant: PANASONIC CORPORATION, Osaka (JP)

(72) Inventors: Hiroyuki Tsubakimoto, Shiga (JP); Fumiaki Sekino, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 386 days.

(21) Appl. No.: 13/658,056

(22) Filed: Oct. 23, 2012

(65) Prior Publication Data

US 2013/0118882 A1 May 16, 2013

(30) Foreign Application Priority Data

Nov. 14, 2011 (JP) ..... 2011-248410

(51) Int. Cl.
*H01H 15/02* (2006.01)
*B25B 21/00* (2006.01)
*B25F 5/00* (2006.01)

(52) U.S. Cl.
CPC ..... *B25B 21/00* (2013.01); *B25F 5/001* (2013.01); *H01H 15/02* (2013.01)

(58) Field of Classification Search
CPC ..... H01H 15/10; H01H 15/02; H01H 1/00; H01H 1/12; H01H 1/16; H01H 3/00; H01H 3/02; H01H 3/08; H01H 3/32; H01H 9/0044; H01H 9/02; H01H 13/02; H01H 13/04; H01H 13/50; H01H 19/00; H01H 19/001; H01H 19/02; H01H 19/14; H01H 25/00; H01H 2003/00; H01H 2009/04; H01H 2009/20; H01H 2025/00; H01H 2221/01; H01H 2223/00; H01H 2223/01; H01H 2231/048; B25F 5/00; B25D 17/00; B25B 21/00
USPC ..... 200/548, 332.2, 410, 527, 544, 560, 200/564, 566, 567, 336, 43.17, 332.3, 16 C, 200/61.76, 458, 282
See application file for complete search history.

(56) References Cited

U.S. PATENT DOCUMENTS 6,105,450 A 8/2000 Sasaki et al.
6,186,709 B1 2/2001 Hsu (Continued)

FOREIGN PATENT DOCUMENTS

CN 101797746 8/2010
DE 3904085 8/1990

(Continued)

OTHER PUBLICATIONS

China Office action, dated Aug. 13, 2014 along with an english translation thereof.

(Continued)

*Primary Examiner* — Edwin A. Leon
*Assistant Examiner* — Anthony R Jimenez
(74) *Attorney, Agent, or Firm* — Greenblum & Bernstein, P.L.C.

(57) ABSTRACT

A switch operation device is for switching between two or more speed change modes of a speed change mechanism by switching a position of a component for use in speed change included in the speed change mechanism, and includes: a main member that is movable between two positions in the switch operation device in an operating direction; a click spring for stopping the main member at one of the two positions; a switch spring that switches the position of the component in conjunction with movement of the main member; a first holding member provided in the main member, and holds the click spring; and a second holding member provided in the main member, and holds the switch spring, wherein when viewed in a direction perpendicular to the operating direction, the first holding and second holding members at least partially overlap with each other.

16 Claims, 4 Drawing Sheets

(56) References Cited

U.S. PATENT DOCUMENTS

| | | | |
|---|---|---|---|
| 2004/0020669 | A1 | 2/2004 | Spielmann et al. |
| 2008/0098842 | A1 | 5/2008 | Spielmann et al. |
| 2010/0186976 | A1 | 7/2010 | Tsubakimoto et al. |

FOREIGN PATENT DOCUMENTS

| | | |
|---|---|---|
| EP | 1364752 | 11/2003 |
| JP | 53-039889 | 4/1978 |
| JP | 54-053789 | 4/1979 |
| JP | 60-196904 | 10/1985 |
| JP | 11-123671 | 5/1999 |
| JP | 2000-24944 | 1/2000 |
| JP | 2002-154062 | 5/2002 |
| JP | 3391845 | 1/2003 |
| JP | 3095407 | 7/2003 |
| JP | 2010-36259 | 2/2010 |
| JP | 2010-046748 | 3/2010 |

OTHER PUBLICATIONS

Japan Office action, mail date is Mar. 24, 2015.

SWITCH OPERATION DEVICE

TECHNICAL FIELD

The present disclosure relates to a switch operation device for switching between two or more speed change modes of a speed change mechanism.

DESCRIPTION OF THE RELATED ART

As a speed change mechanism for use in electric tools such as impact tools and drill tools, there has conventionally been used a three-stage speed change mechanism for switching the rotation speed to be output between three stage rotation speeds by moving a pulley, as disclosed in Patent Literature 1. Such a three-stage speed change mechanism includes a push-button that moves among a forward edge position, a backward edge position, and a middle position. This movement of the push-button is transmitted to the pulley via a shrunk ring, the position of the pulley is switched in conjunction with the movement of the push-button, and as a result the rotation speed to be output by the three-stage speed change mechanism is switched in the three-stage manner. Accordingly, the push-button functions an operation member for switching the rotation speed. The push-button has provided thereon a flange. When the push-button is operated, the flange fits into any of respective concave parts corresponding to three positions provided in a case forming an outer shell of the electric tool so as to stop the push-button at any one of the positions and hold the push button in the position.

CITATION LIST

Patent Literature

[Patent Literature 1]
Japanese Utility Model Registration No. 3095407

SUMMARY

One non-limiting and exemplary embodiment provides a switch operation device whose size is easily reduced.

In one general aspect, the techniques disclosed here feature, a switch operation device for switching between two or more speed change modes of a speed change mechanism by switching a position of a component for use in speed change included in the speed change mechanism, the switch operation device comprising: a main member that is movable between two positions in the switch operation device in an operating direction; a click spring that is for stopping the main member at one of the two positions; a switch spring that switches the position of the component in conjunction with movement of the main member between the two positions; a first holding member that is provided in the main member, and holds the click spring; and a second holding member that is provided in the main member, and holds the switch spring, wherein when viewed in a direction perpendicular to the operating direction, the first holding member and the second holding member at least partially overlap with each other so as to form an overlap region.

The above one aspect of the present invention exhibits an effect that it is easy to reduce the size of the switch operation device.

These general and specific aspects may be implemented using a manufacturing method.

Additional benefits and advantages of the disclosed embodiments will be apparent from the specification and figures. The benefits and/or advantages may be individually provided by the various embodiments and features of the specification and drawings disclosure, and need not all be provided in order to obtain one or more of the same.

DETAILED DESCRIPTION

Figure 1A:
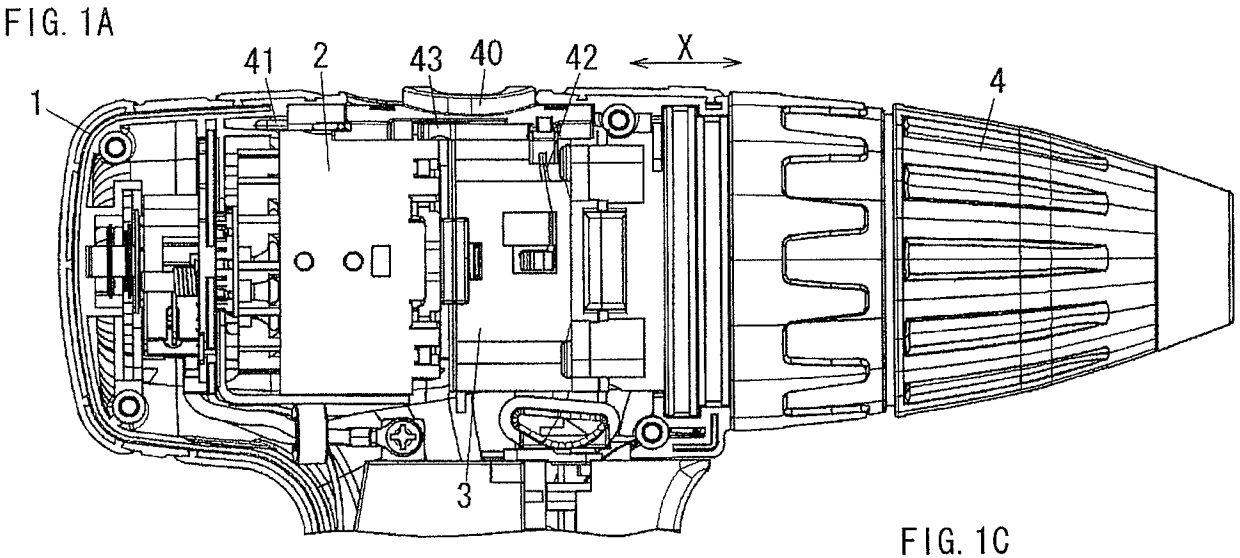
FIG. 1A is a side view showing a periphery of a drive unit of a conventional electric tool whose an outer shell is partially transparently shown.

The following describes one aspect of the present invention based on an embodiment shown in the drawings.

Prior to the specific description of the structure of the embodiment, a structural example of a conventional electric tool is shown, and description is given on the point on which the present inventors have focused attention.

Figure 1B:
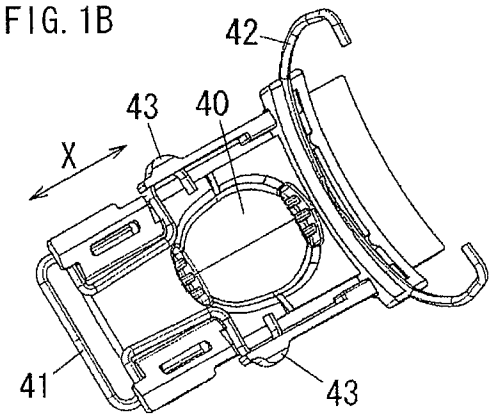
FIG. 1B is a perspective view showing a handle of the conventional electric tool.
Figure 1C:
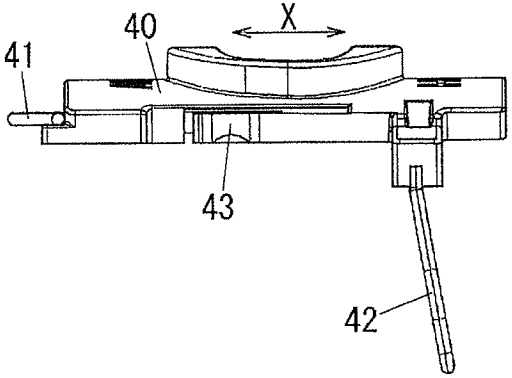
FIG. 1C is a side view showing the handle of the conventional electric tool.

FIG. 1A to FIG. 1C show structural examples of a conventional electric tool. FIG. 1A is a side view showing a periphery of a drive unit of a conventional electric tool whose an outer shell is partially transparently shown as an example. FIG. 1B is a perspective view showing a handle of the conventional electric tool as an example. FIG. 1C is a side view showing the handle of the conventional electric tool as an example. The electric tool shown in FIG. 1A to FIG. 1C includes a handle 40 that is slidable between two positions, as an operation member for performing switch operations on a speed change mechanism. The handle 40 includes click protrusions 43 for use in stopping the handle 40 at any one of switch positions. On each of both side surfaces of the housing 1 for guiding movement of the handle 40, a projection part or a concave part (not illustrated) is provided in each of the two positions to which the handle 40 moves. The projection part or the concave part is able to retain the click protrusion 43 corresponding in position. When the handle 40 slidably moves, the click protrusions 43 are each retained by the projection part or the like. This stops the handle 40 at a predetermined position and holds the handle 40 in the predetermined position.

Also, the handle 40 includes, on a surface thereof facing inward (namely, an inner surface thereof), an elastic click spring 41 and a speed change spring 42 that moves components for speed change included in a speed change mechanism unit. The speed change spring 42 moves the components for speed change in conjunction with movement of the handle 40, thereby to switch the operation mode of the speed change mechanism unit, namely, changes the speed of the speed change mechanism unit. Also, the click spring 41 forces the click protrusions 43 toward the respective side surfaces of the housing 1 for guiding movement so as to be elastically retained by the projection part or the like of the housing 1. This gives fixability to the handle 40. As a result, compared with Patent Literature 1, this conventional electric tool easily performs switch operations. This suppresses wear of the handle 40 due to abrasion of the click protrusion 43 (flange) and the like resulting from repetition of operations.

By the way, according to the structure of the conventional electric tool shown in FIG. 1A to FIG. 1C, the speed change spring 42 and the click spring 41 are provided on the inner surface of the handle 40 so as to be at a predetermined distance from each other in a sliding direction of the handle 40 (operating direction X). For this reason, according to the structure of the conventional electric tool shown in FIG. 1A to FIG. 1C, it is difficult to reduce the length of the handle 40 in the operating direction X, that is, it is difficult to make the handle 40 to be compact.

<Outline of Aspects of Invention>

One aspect of the present invention provides a switch operation device for switching between two or more speed change modes of a speed change mechanism by switching a position of a component for use in speed change included in the speed change mechanism, the switch operation device comprising: a main member that is movable between two positions in the switch operation device in an operating direction; a click spring that is for stopping the main member at one of the two positions; a switch spring that switches the position of the component in conjunction with movement of the main member between the two positions; a first holding member that is provided in the main member, and holds the click spring; and a second holding member that is provided in the main member, and holds the switch spring, wherein when viewed in a direction perpendicular to the operating direction, the first holding member and the second holding member at least partially overlap with each other so as to form an overlap region.

Also, in another aspect of the present invention, according to this switch operation device, when viewed in the direction perpendicular to the operating direction, the switch spring and the click spring may at least partially overlap with each other so as to form an overlap region.

Also, in another aspect of the present invention, according to this switch operation device, in the overlap region between the switch spring and the click spring, the switch spring may be positioned between the main member and the click spring in the direction perpendicular to the operating direction.

Also, in another aspect of the present invention, according to this switch operation device, in the overlap region between the switch spring and the click spring, the click spring may be positioned between the main member and the switch spring in the direction perpendicular to the operating direction.

Also, in another aspect of the present invention, according to this switch operation device, the main member may be plate-like, the click spring may be U-shaped, and may have two opposing sides whose respective centers curve toward each other, the switch spring may be arc-shaped, and may have a center that curves outward so as to form a convex part having a curve, the first holding member and the second holding member may be provided on one of main surfaces of the main member, the operating direction may be a direction along the main surface, the first holding member may hold the click spring so as to be held along the main surface, the second holding member may hold the switch spring so as to be held along a planar surface perpendicular to the main surface, and in the overlap region between the switch spring and the click spring, the respective curved centers of the sides of the click spring may be positioned inside of the curve of the convex part of the curved center of the switch spring.

Also, in another aspect of the present invention, according to this switch operation device, the main member may be plate-like, the click spring may be U-shaped, and may have two opposing sides whose respective centers curve toward each other, the switch spring may be arc-shaped, and may have a center that curves inward so as to form a concave part having a curve, the first holding member and the second holding member may be provided on one of main surfaces of the main member, the operating direction may be a direction along the main surface, the first holding member may hold the click spring so as to be held along the main surface, the second holding member may hold the switch spring so as to be held along a planar surface perpendicular to the main surface, and in the overlap region between the switch spring and the click spring, the respective curved centers of the sides of the click spring may be positioned inside the curve of the concave part of the curved center of the switch spring.

Also, in another aspect of the present invention, according to this switch operation device, the first holding member may hold the click spring such that the sides of the click spring are positioned in the operating direction, and the second holding member may hold the switch spring so as to be held along a planar surface perpendicular to the operating direction.

Furthermore, another aspect of the present invention provides an electric tool comprising the switch operation device of any one of the above aspects.

<Embodiment>

Figure 2:
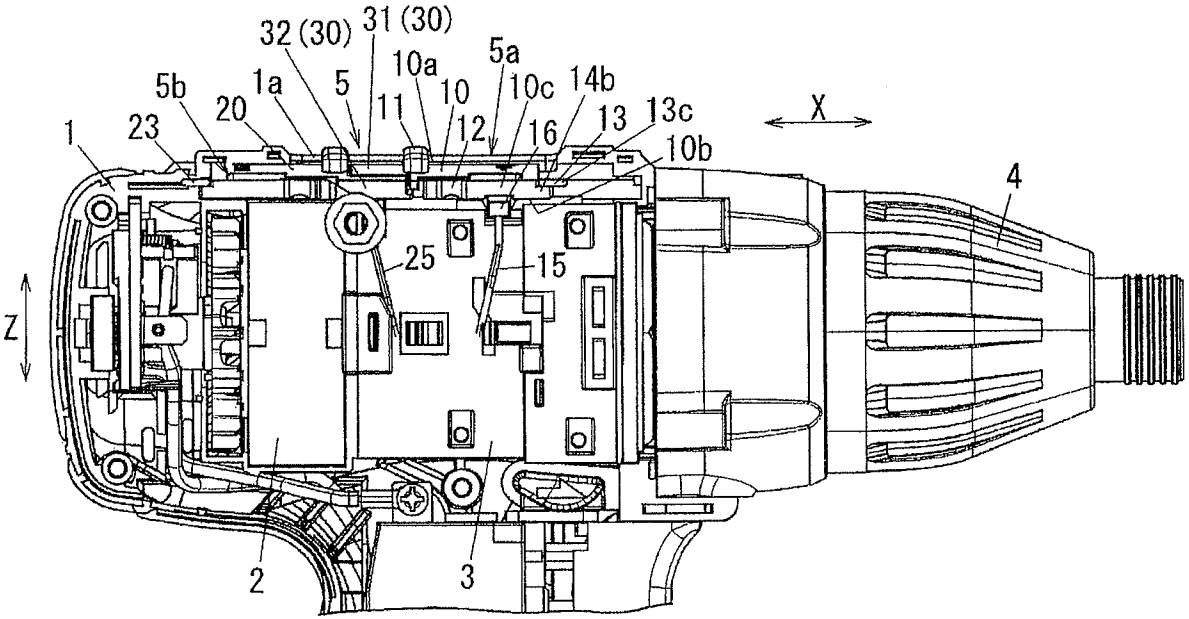
FIG. 2 is a side view showing a periphery of a drive unit of an electric tool relating to an embodiment whose outer shell is partially shown.

FIG. 2 shows an electric tool relating to an embodiment that is one aspect of the present invention. The electric tool includes a drive unit that outputs rotational power, a grip unit (not illustrated) for a user to hold in use and a feed unit (not illustrated) that feeds electric power to the drive unit. The drive unit includes a motor 2 functioning as a drive source, a speed change mechanism unit 3, and an output unit 4. The rotational power of the motor 2 is transferred to the output unit 4 via the speed change mechanism unit 3, and is output from the output unit 4.

Also, the electric tool has an outer shell formed by a housing 1 and the output unit 4. The housing 1 houses therein the motor 2 and the speed change mechanism unit 3. The housing 1 has an opening 1*a* at a part thereof covering an outer surface of the speed change mechanism unit 3. A switch operation device 5 is provided so as to be partially exposed outside of the housing 1 via the opening 1*a*. The switch operation device 5 will be detailed later.

The speed change mechanism unit 3 includes two components (not illustrated) that are each movable between two positions. Combination of the respective positions of the two components allows switching among three speed change modes. The components are used for switching among the speed change modes. For example, the speed change mode is switchable between a low speed mode for outputting rotational power at a low speed and a high torque, a high speed mode for outputting rotational power at a higher speed and a lower torque compared to the low speed mode, and a medium speed mode for outputting rotational power at a speed and a torque that are intermediate between the high speed mode and the low speed mode. Furthermore, the respective positions of the components are switchable by the switch operation device 5 that is used for switching the speed change mode of the speed change mechanism unit 3.

Figure 3B:
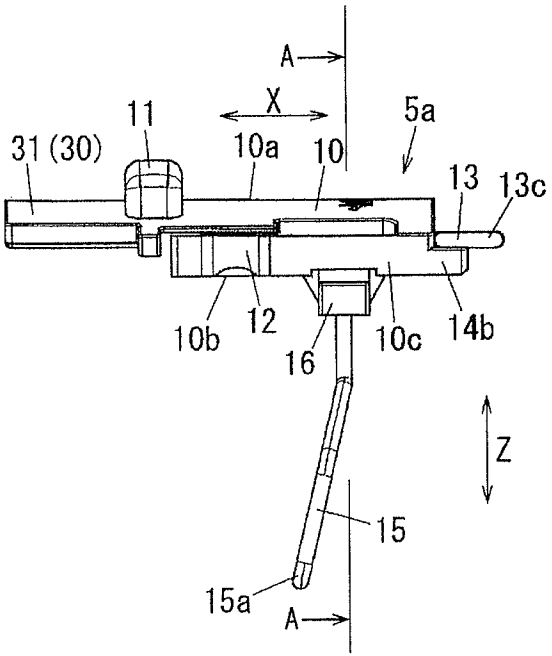
FIG. 3A and FIG. 3B are a perspective view and a side view of a first operation unit of a switch operation device relating to the embodiment, respectively.
Figure 3A:
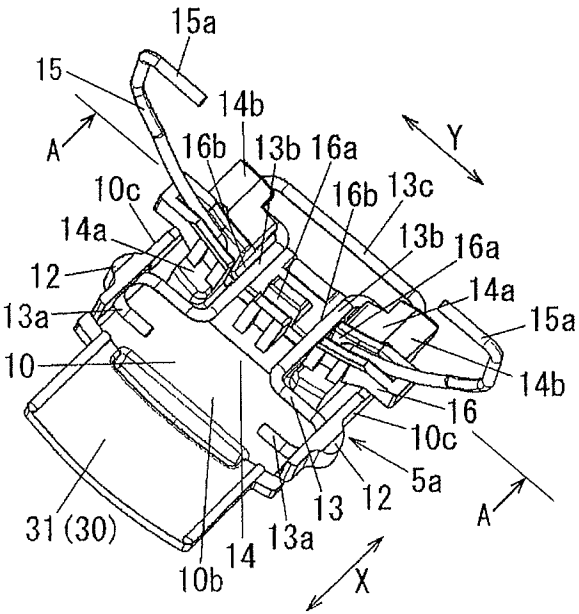

The switch operation device 5 includes a first operation unit 5*a* that moves one of the components and a second operation unit 5*b* that moves the other one of the components. The first operation unit 5*a* includes, as shown in FIG. 3A and FIG. 3B, a main member 10, a click spring 13, and a switch spring 15.

The main member 10 is plate-like, and is provided inside the housing 1 so as to be slidable in the axis direction of the motor 2 as shown in FIG. 2. The main member 10 moves between two positions in this axis direction of the motor 2. The main member 10 has a plate surface (outer surface 10*a*) that is partially exposed outside the housing 1 via the opening 1*a* and a plate surface (inner surface 10*b*) facing the speed change mechanism unit 3. Hereinafter, a direction in which the main member 10 is slidable is defined as an operating direction X, and the above two positions where the main member 10 stops after sliding are each defined as a switch position. Also, a direction perpendicular to the operating direction X on the plate surfaces is defined as a width direction Y, and a direction perpendicular to the operating direction X and the width direction Y (namely, a direction perpendicular to the plate surfaces) is defined as a thickness direction Z.

Also, on the outer surface 10*a* of the main member 10, an operating part 11 on which a user is to hook his finger for performing operation is provided so as to project outward. The operating part 11 makes it easier for the user to slide the main member 10. Furthermore as shown in FIG. 3A and FIG. 3B, in each of respective two surfaces of the main member 10 at both ends in the width direction Y (namely, side surfaces 10*c*), a click protrusion 12 is provided.

The click protrusion 12 protrudes from the main member 10 in a direction substantially perpendicular to the side surface 10*c*. When the main member 10 slides, the click protrusion 12 fits into a concave part that is provided at each of the switch positions, such that the main member 10 is stopped at any one of the switch positions.

The main member 10 includes, on the inner surface 10*b*, a first holding unit 14 that holds the click spring 13 and a second holding unit 16 that holds a switch spring 15. The click spring 13 and the switch spring 15 are fixed to the main member 10 via the first holding unit 14 and the second holding unit 16, respectively.

The click spring 13 is formed from mainly a wire spring that is bent so as to form a U-shape. Two opposing sides of the U-shape curve toward each other at respective centers 13*b* thereof. Therefore, the click spring 13 is π-shaped when viewed in plan. The click spring 13 has an end part 13*a* that is positioned inside each of the click protrusions 12 in the side surfaces 10*c* to force the click protrusion 12 outward. As a result of being forced by the click spring 13, the click protrusion 12 elastically fits into the concave part, and this gives the main member 10 fixability in switching between the switch positions.

The first holding unit 14 is concaved from the inner surface 10*b* toward the outer surface 10*a* of the main member 10. When viewed in plan, the concaved first holding unit 14 has an H-shape so as to correspond to the shape of the click spring 13. The clip spring 13 is positioned inside the concaved first holding unit 14. The first holding unit 14 has parts 14*a* between the two opposing sides thereof. The clip spring 13 is held by the first holding unit 14 such that the parts 14*a* fits into the respective curved centers 13*b* of the clip spring 13. This allows the first holding unit 14 to fixedly hold the clip spring 13 in the width direction Y and the operating direction X.

Also, the first holding unit 14 has a concave on the reverse side of the click protrusion 12 provided in each of the side surfaces 10*c*. The end parts of 13*a* of the click spring 13 are positioned inside the respective concaves. Accordingly, the click spring 13 elastically forces the click protrusion 12 outward in the width direction Y.

Also, the click spring 13 has a base part 13*c* that connects the two opposing sides thereof. The parts 14*a* each has a holding part 14*b* that holds the base part 13*c* from the side of the inner surface 10*b* (the side of the speed change mechanism unit 3). As a result, the click spring 13 is retained by the holding part 14*b* and the concave provided on the reverse side of the click protrusion 12 of each of the side surfaces 10*c*, and is fixed to the main member 10 in the thickness direction Z.

The switch spring 15 moves and pressurizes the components for speed change. When viewed in the operating direction X, the switch spring 15 is arc-shaped. The speed change mechanism unit 3 is positioned inward the switch spring 15. The switch spring 15 has an end part 15*a* (not illustrated in FIG. 2) that is attached to the components for speed change. When the main member 10 slidably moves to one of the switch positions, the switch spring 15 moves each of the components for speed change. Note that the switch spring 15 pressurizes the components for speed change, by applying pressure to the components for speed change in the operating direction X. For example, the switch spring 15 elastically holds each of the components, which has been moved to a predetermined position, to prevent the component from displacing. Also for example, the switch spring 15 elastically forces the component to facilitate the component to move to the predetermined position.

The second holding unit 16 is provided on and between the parts 14*a* in the width direction Y. When viewed in the operating direction X, the second holding unit 16 is arc-shaped. The second holding unit 16 has a concave 16*a* that concaves outward (namely, toward the outer surface 10*a* of the main member 10) inside which the switch spring 15 is inserted. The switch spring 15 is fixed to the main member 10 at a predetermined position in the circumferential direction of the second holding unit 16 and the operating direction X.

Also, the second holding unit 16 has cuts 16*b* corresponding in position to the respective curved centers 13*b* of the click spring 13. The curved centers 13*b* are positioned inside the respective cuts 16*b*. In the cut 16*b*, the concave 16*a* is provided so as to be closer to the outer surface 10*a* than the first holding unit 14.

Figure 4A:
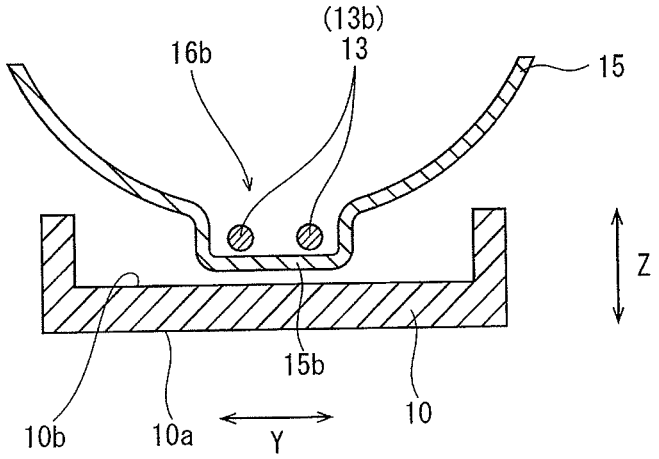
FIG. 4A is a cross-sectional view schematically showing the relative positional relation among a main member, a switch spring, and a click spring of the switch operation device relating to the embodiment.

Here, FIG. 4A is a cross-sectional view schematically showing the relative positional relation in the thickness direction Z among the main member 10, the click spring 13, and the switch spring 15. FIG. 4A is a schematic cross-sectional view showing the first operation unit 5*a* taken along line A-A shown in FIG. 3A and FIG. 3B. Note that, for simplification of illustration, the first holding unit 14 and the second holding unit are omitted in FIG. 4A. As shown in FIG. 4A, the switch spring 15 is bent so as to project outward to form a convex part 15*b* corresponding in position to the cut 16*b*. Accordingly, in the position corresponding to the cuts 16*b*, the switch spring 15 is held by the second holding unit 16 (specifically the concave 16*a*) so as to be closer to the outer surface 10*a* than the first holding unit 14. That is, in the position corresponding to the cut 16*b*, the switch spring 15 is held between the main member 10 and the curved centers 13*b* of the click spring 13.

In other words, when viewed in the thickness direction Z, the second holding unit 16 by which the switch spring 15 is held is positioned so as to partially overlap with the first holding unit 14 by which the click spring 13 is held. The second holding unit 16 holds, in the thickness direction Z, the switch spring 15 so as to be positioned between the main member 10 and the click spring 13.

In this way, the first holding unit 14 and the second holding unit 16 are positioned so as to partially overlap with each other. This reduces the size (namely, length) of the main member 10 in the operating direction X, compared with a case where the second holding unit 16 is positioned at a distance from the first holding unit 14 in the operating direction X. As a result, it is easy to reduce the size of the main member 10 (the first operation unit 5*a*) in the operating direction X.

Furthermore, the second holding unit 16 holds the switch spring 15 between the main member 10 and the click spring 13 in the thickness direction Z. This reduces the size (namely, thickness) of the main member 10 in the thickness direction Z. Accordingly, it is easy to reduce the size of the first operation unit 5*a* not only in the operating direction X but also in the thickness direction Z, compared with a case where the click spring 13 and the switch spring 15 do not overlap with each other in the thickness direction Z, that is, compared with a case where, when viewed in the operating direction X and the width direction Y, the click spring 13 and the switch spring 15 do not overlap with each other.

Furthermore as described above, the second holding unit 16 holds the switch spring 15 between the main member 10 and the click spring 13 in the thickness direction Z. The click spring 13 prevents detachment of the switch spring 15. As a result, the second holding unit 16 does not need to include a latching part for retaining the switch spring 15 in the thickness direction Z such as a claw. Therefore, it is easily to reduce the size and structural complications of the second holding unit 16. Otherwise, the second holding unit 16 would be larger with more complicated structure due to the restrictions on the shape, the provision position, and the like resulting from the need to form the latching part, and would lead to the increase in size of the first operation unit 5*a*.

Also, the second operation unit 5*b* includes, as shown in FIG. 2, a second main member 20, a second click spring 23, a second switch spring 25, a third holding unit (not illustrated) for the second click spring 23, and a fourth holding unit (not illustrated) for the second switch spring 25.

The second main member 20 is provided inside the housing 1 so as to be slidable, and moves between two switch positions in the operating direction X. The third holding unit is provided on an inner surface of the second main member 20. The second click spring 23 is held by the second main member 20 via the third holding unit. Hereinafter, the main member 10 included in the first operation unit 5*a* is referred to as "first main member 10". Also, in the case where the first operation unit 5*a* and the second operation unit 5*b* do not especially need to be distinct from each other for description, the first main member 10 and the second main member 20 are just referred to as "main members 10 and 20".

Furthermore, in the present embodiment, the first operation unit 5*a* and the second operation unit 5*b* have a slide range overlapping therebetween in the operating direction X. While the switch operation device 5 is in an adjacent state in which one of the main members 10 and 20 is positioned within a slide range of the other of the main members 10 and 20, the one main member, which is positioned within the slide range of the other main member, is operable and the other main member is inoperable. On the contrary, while the switch operation device 5 is in a distant state in which the main members 10 and 20 are distant from each other, either one of the main members 10 and 20 is selectively operable. When either one of the main members 10 and 20 is selectively operated, the switch operation device 5 switches to the adjacent state.

Accordingly, the switch operation device 5 is switchable among three states, namely, the distant state, an adjacent state in which the main member 10 is in the slide range of the main member 20, and an adjacent state in which the main member 20 is in the slide range of the main member 10. The three speed change modes of the speed change mechanism unit 3 each correspond to a different one of the three states.

Also, the first operation unit 5*a* has an overlapping part 30 at the end of the main member 10 opposing the main member 20 of the second operation unit 5*b*. Similarly, the second operation unit 5*b* has an overlapping part 30 at the end of the main member 20 opposing the main member 10 of the first operation unit 5*a*. These overlapping parts 30 extend toward each other. Hereinafter, in the case where the first operation unit 5*a* and the second operation unit 5*b* need to be distinct from each other for description, the overlapping part 30 provided on the first operation unit 5*a* is referred to as "first overlapping part 31", and the overlapping part 30 provided on the second operation unit 5*b* is referred to as "second overlapping part 32".

While in the adjacent state in which the main members 10 and 20 are adjacent to each other, the second overlapping part 32 is positioned under the first overlapping part 31, and accordingly the first overlapping part 31 covers substantially the entire of the outer surface of the second overlapping part 32. On the contrary, while in the distant state in which the main members 10 and 20 are distant from each other, the first overlapping part 31 covers the edge of the outer surface of the second overlapping part 32, and exposes remaining parts of the outer surface of the second overlapping part 32.

According to this structure, while it is possible to provide the fourth holding unit in the second overlapping part 32 positioned under the first overlapping part 31 in the thickness direction Z, it is impossible to provide the second holding unit 16 in the first overlapping part 31.

In the present embodiment, the fourth holding unit is provided in the second overlapping part 32 of the second 5*b*, and the second switch spring 25 is held by the second main member 20 at the second overlapping part 32. This eliminates the need for the second operation unit 5*b* to reserve any space in the second main member 20 for the fourth holding unit, thereby reducing the length of the second main member 20. Furthermore, according to the structure of the electric tool relating to the present embodiment, it is easy to reduce the size of the opening 1*a*, by overlapping the slide range of the first operation unit 5*a* and the slide range of the second operation unit 5*b* with each other and providing the first overlapping part 31 and the second overlapping part 32.

<Modification Examples>

The present invention is not limited to the structure of the embodiment that is one aspect thereof, and is appropriate design modifications may be made on the embodiment without departing from the scope of the present invention.

<Modification Example 1>

For example, the click spring 13 may have an H-shape. In this case, the click spring 13 has two opposing sides whose respective centers curve toward each other, so as to be equivalent to the curved centers 13*b* in the case where the click spring 13 has the U-shape. Also, the speed change mechanism unit 3 may be capable of switching between two speed change modes, for example. Furthermore, the switch operation device 5 may include only the first operation unit 5*a* without including the second operation unit 5*b*, for example.

<Modification Example 2>

Figure 4B:
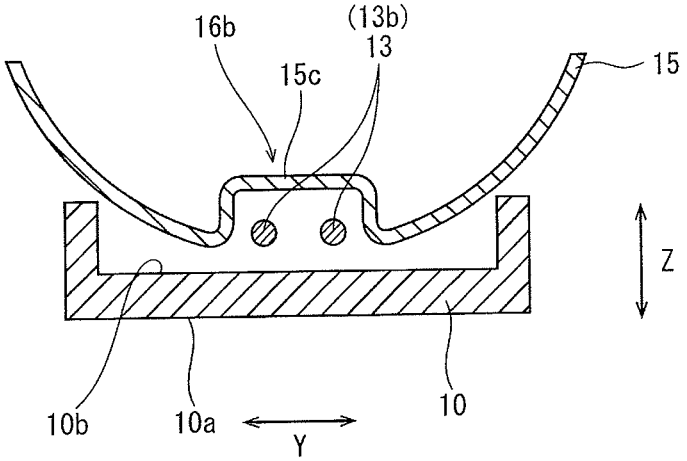
FIG. 4B is a schematic cross-sectional view showing the relative positional relation among a main member, a switch spring, and a click spring of a switch operation device relating to a modification example.

Furthermore, the switch spring 15 may have, in the cut 16*b*, a concave part 15*c* that is concaved inward. And, the click spring 13 may be held by the first holding unit 14 such that the curved centers 13*b* of the click spring 13 are positioned inside the concave part 15*c*. FIG. 4B schematically shows the relative positional relation in the thickness direction Z among the main member 10, the click spring 13, and the switch spring 15 relating to the present modification example. FIG. 4B is a schematic cross-sectional view showing the first operation unit 5*a* taken along line A-A shown in FIG. 3A and FIG. 3B.

Note that, for simplification of illustration, the first holding unit 14 and the second holding unit 16 are omitted in FIG. 4B. In the present modification as shown in FIG. 4B, in the cut 16*b*, the curved centers 13*b* of the click spring 13 are held between the main member 10 and the switch spring 15.

<Modification Example 3>

Also, the electric tool may be an impact tool that includes an impact mechanism for transferring rotational power to striking movement as part of the speed change mechanism unit 3. The switch operation device 5 included in such an electric tool switches, by operating the first operation unit 5*a* for example, the speed change mechanism unit 3 between an impact mode for enabling the impact mechanism to perform striking operations and a drill driver mode for disabling the impact mechanism. When in the drill driver mode, the second operation unit 5*b* becomes operable. When the second operation unit 5*b* is operated, the switch operation device 5 switches the speed change mechanism unit 3 between the low speed mode at a low speed and a high torque and the high speed mode at a high speed and a low torque.

The invention claimed is:

1. A switch operation device for switching between two or more speed change modes of a speed change mechanism by switching a position of a component for use in speed change included in the speed change mechanism, the switch operation device comprising:

a main member configured to move between two positions in the switch operation device in an operating direction;

a click spring configured to latch the main member at one of the two positions;

a switch spring configured to switch the position of the component in conjunction with movement of the main member between the two positions;

a first holding member provided in the main member and holding the click spring; and a second holding member provided in the main member and holding the switch spring, wherein when viewed in a direction perpendicular to the operating direction, the first holding member and the second holding member at least partially overlap with each other to define a holding member overlap region, and the click spring comprising a bended wire having a first U-shaped portion, a second U-shaped portion and a middle portion, wherein the first U-shaped portion is provided at a first end of the middle portion and the second U-shaped portion is provided at a second end of the middle portion, and wherein a bottom portion of the first U-shaped portion faces a bottom portion of the second U-shaped portion.

2. The switch operation device of claim 1, wherein when viewed in the direction perpendicular to the operating direction, the switch spring and the click spring at least partially overlap with each other to define a spring overlap region.

3. The switch operation device of claim 2, wherein in the spring overlap region, the switch spring is positioned between the main member and the click spring in the direction perpendicular to the operating direction.

4. The switch operation device of claim 2, wherein in the spring overlap region, the click spring is positioned between the main member and the switch spring in the direction perpendicular to the operating direction.

5. The switch operation device of claim 3, wherein the main member has a generally planar surface, the switch spring is arc-shaped, and has a center that curves outward to define a convex part having a curve, the first holding member and the second holding member are provided on one of main surfaces of the main member, the operating direction is a direction along the main surface, the first holding member holds the click spring along the main surface, the second holding member holds the switch spring along a planar surface perpendicular to the main surface, and in the spring overlap region, the respective curved centers of the sides of the click spring are positioned inside of the curve of the convex part of the curved center of the switch spring.

6. The switch operation device of claim 4, wherein the main member has a generally planar surface, the switch spring is arc-shaped, and has a center that curves inward to define a concave part having a curve, the first holding member and the second holding member are provided on one of main surfaces of the main member, the operating direction is a direction along the main surface, the first holding member holds the click spring along the main surface, the second holding member holds the switch spring along a planar surface perpendicular to the main surface, and in the spring overlap region, the respective curved centers of the sides of the click spring are positioned inside the curve of the concave part of the curved center of the switch spring.

7. The switch operation device of claim 5, wherein the first holding member holds the click spring such that the sides of the click spring are positioned in the operating direction, and the second holding member holds the switch spring along a planar surface perpendicular to the operating direction.

8. The switch operation device of claim 6, wherein the first holding member holds the click spring such that the sides of the click spring are positioned in the operating direction, and the second holding member holds the switch spring along a planar surface perpendicular to the operating direction.

9. An electric tool comprising the switch operation device of claim 1.

10. An electric tool comprising the switch operation device of claim 2.

11. An electric tool comprising the switch operation device of claim 3.

12. An electric tool comprising the switch operation device of claim 4.

13. An electric tool comprising the switch operation device of claim 5.

14. An electric tool comprising the switch operation device of claim 6.

15. An electric tool comprising the switch operation device of claim 7.

16. An electric tool comprising the switch operation device of claim 8.

* * * * *